United States Patent [19]

Hart

[11] 4,060,130

[45] Nov. 29, 1977

[54] CLEANOUT PROCEDURE FOR WELL WITH LOW BOTTOM HOLE PRESSURE

[75] Inventor: Joseph I. Hart, Pointe-a-Pierre, Trinidad and Tobago

[73] Assignee: Texaco Trinidad, Inc., Pointe-a-Pierre, Trinidad and Tobago

[21] Appl. No.: 700,624

[22] Filed: June 28, 1976

[51] Int. Cl.[2] ..... E21B 21/00; E21B 43/25

[52] U.S. Cl. ..... 166/312; 166/267

[58] Field of Search ..... 166/250, 267, 311, 312; 175/69, 215

[56] References Cited

U.S. PATENT DOCUMENTS

| | | | |
|---|---|---|---|
| 1,484,601 | 2/1924 | Carmichael | 166/312 |
| 2,726,063 | 12/1955 | Ragland et al. | 175/69 |
| 2,768,694 | 10/1956 | Moll et al. | 166/312 X |
| 3,268,017 | 8/1966 | Yarbrough | 175/215 X |
| 3,464,495 | 9/1969 | Childers et al. | 166/312 |
| 3,497,020 | 2/1970 | Kammerer, Jr. | 175/69 |
| 3,534,822 | 10/1970 | Campbell | 175/69 |

*Primary Examiner*—Stephen J. Novosad
*Assistant Examiner*—George A. Suchfield
*Attorney, Agent, or Firm*—Thomas H. Whaley; Carl G. Ries; Henry C. Dearborn

[57] ABSTRACT

A cleanout procedure for use in a well with low bottom hole pressure that has become filled with sand. It employs a conductor string of pipe and a wash string of pipe inside the conductor string, both inserted in the well. A high pressure gas is applied to the inner annulus formed by the conductor and wash string, and the workover wash fluid is circulated down the wash string up the outer annulus formed by the well casing and the conductor string, to be joined by the gas and so wash out the sand through the outer annulus. Sand is separated at the surface.

10 Claims, 3 Drawing Figures

CLEANOUT PROCEDURE FOR WELL WITH LOW BOTTOM HOLE PRESSURE

BACKGROUND OF THE INVENTION

1. Field of the Invention

This invention concerns oil well procedures in general, and particularly relates to a cleanout procedure for oil wells with low bottom hole pressure which have become sanded up.

2. Description of the Prior Art

Heretofore, when low pressure oil wells become clogged up by the infiltration of sand, it was necessary to remove such sand by use of a wire line bailer. It was a relatively slow and consequently expensive procedure. While other procedures are known, such as the use of foam to circulate out the sand from the bottom of the well, they may adversely affect the producing formation.

Another prior proposal is described in U.S. Pat. No. 3,163,226. It employed special equipment and tools, which would have to be inserted downhole for the cleanout procedure and then removed thereafter prior to producing once more.

Consequently, it is an object of this invention to provide a method of cleaning out a low pressure well, which method is very effective and time saving, without having any adverse effect on the producing formation or formations downhole.

SUMMARY OF THE INVENTION

Briefly, the invention concerns a cleanout procedure for a low pressure well containing sand fill, which procedure comprises the steps of inserting a first string of pipe in said well and forming an outer annulus there around in the well. The said first string extends below the static fluid level in said well. The procedure also comprises inserting a second string of pipe inside said first string, and forming an inner annulus between said strings. The said second string extends adjacent to the top of said sand fill. The procedure also comprises applying gas under pressure to one of said annuli, and circulating a wash fluid down said second string of pipe to wash out sand with gas entrained fluid through the other of said annuli.

Again briefly, the invention concerns a cleanout procedure for a low pressure well having a casing head and a string of producing tubing therein, and containing sand fill. The procedure comprises the steps of removing said production string, and determining the static fluid level and the level of sand fill in said well. It also comprises inserting a first string of conductor pipe in said well to form an outer annulus between the walls of said well and the outside of said conductor pipe string. It also comprises landing said first string of conductor pipe for support thereof at said casing head, with the bottom above said sand fill level but below said static fluid and connecting an inlet connector for high pressure gas to the inside of said first string of conductor pipe. It also comprises connecting an outlet connector for a return line to carry effluent from said outer annulus to a separator, and inserting a second string of circulating fluid pipe inside said first string of conductor pipe to form an inner annulus between said first and second strings. It also comprises attaching said second string of pipe to a swivel with the bottom of the string at the level of said sand fill, and applying high pressure gas to said inlet connector for unloading fluid from said inner annulus via said outer annulus. It also comprises starting to circulate wash fluid down through said second string of pipe while adjusting said application of high pressure gas to maintain circulation in gentle surges, and washing down with said second string of pipe to clean out said sand.

BRIEF DESCRIPTION OF THE DRAWINGS

The foregoing and other objects and benefits of the invention will be more fully set forth below in connection with the best mode contemplated by the inventor of carrying out the invention, and in connection with which there are illustrations provided in the drawings, wherein.

DESCRIPTION OF THE PREFERRED EMBODIMENT

It has been found that because of the low bottom hole pressure in depleted oil wells, the normal procedure for cleaning out sand by circulation was not possible. The conventional method was wire line bailing of the sand, and that was found uneconomic especially where long downhole intervals were involved. Furthermore, the wells tended to sand up quickly after cleanout had been accomplished. And in addition, gelled fluids which have been used on wells with low fluid levels to obtain circulation, have caused results which indicated that there was formation damage. Consequently, bailing of sand has remained the most usual clean out procedure.

In many oil fields, the number of wells that are maintained on production is reduced because of the uneconomic situation in regard to the necessary cleanout for continuing production. Cleanout activity under the prior known arrangements is limited by the economics of low producing wells. However, this invention provides a circulating cleanout procedure that is useful for wells with low bottom hole pressure. It employs a high pressure gas to establish a fluid with sand return to the surface. The procedure utilizes no special equipment, but makes use of a available high pressure gas source and a convenient circulating fluid.

Figure 1:
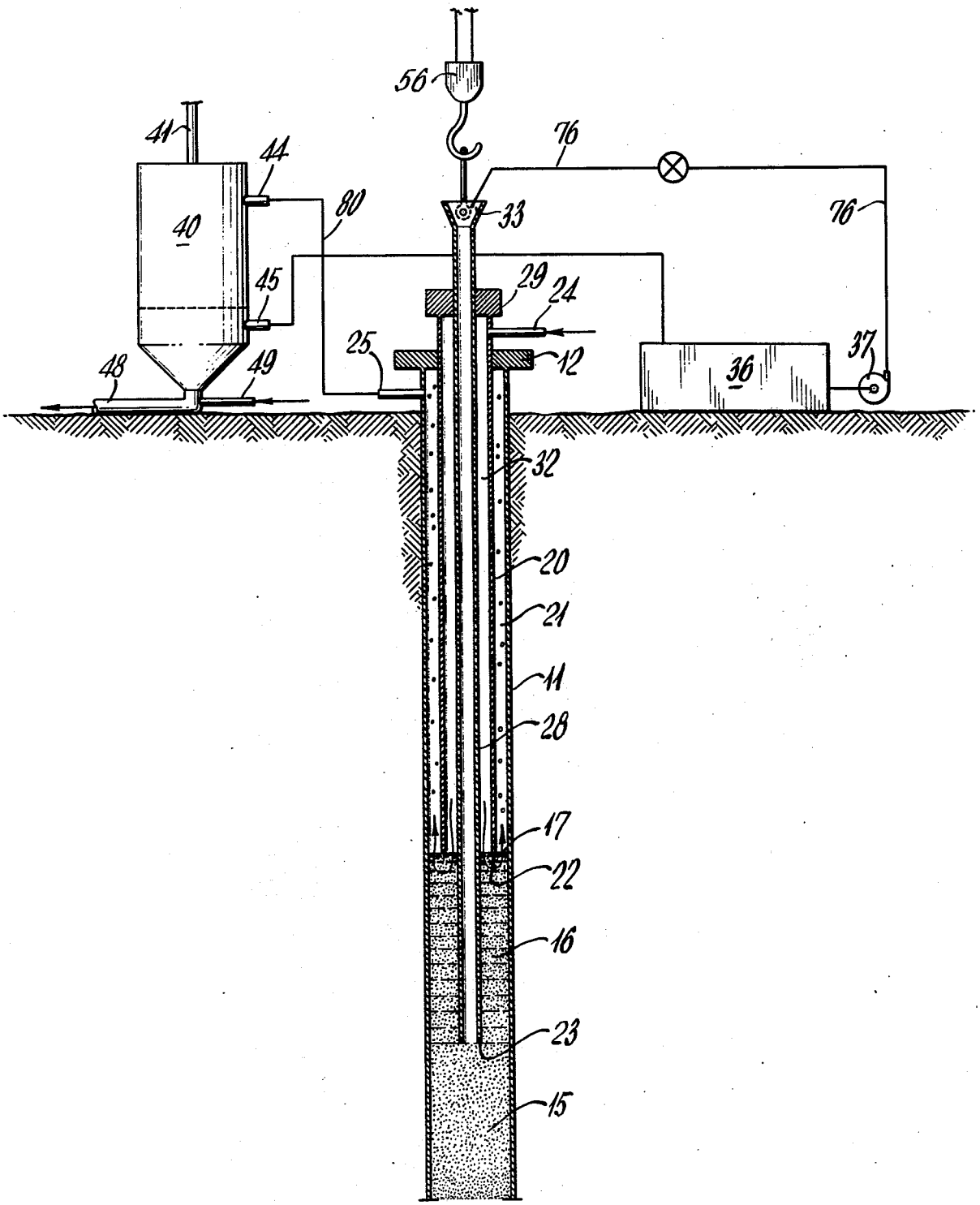
FIG. 1 is a schematic sectional view, illustrating a well with equipment therein for carrying out a procedure according to this invention.

Referring to the drawings, it will be observed from FIG. 1 that there is illustrated a cased well 11 that has a casing head 12 at the surface. As indicated, the well 11 has become filled with sand 15 opposite the producing interval. And, because the well is a low pressure one, this sand 15 has choked off the production of oil and/or gas. Above the sand 15, there is well fluid 16 which has reached a static fluid level 17, illustrated.

Before the well 11 became sanded up, there would have been production tubing (not shown) for carrying the produced oil and/or gas from down hole to the surface. Consequently, the cleanout method according to this invention may involve a first step of moving of such production string in order to be able to proceed. Then a next step of the procedure is to insert a first string of conductor pipe 20 that forms an outer annulus 21 between it and the walls of the well 11. This string of conductor pipe 20 will be extended down in the hole with its bottom end 22 above the level of the sand fill 15, but below the level of the static fluid 16. The string 20 is landed (for support) at the casing head 12, at a predetermined depth in the well.

There is an inlet fluid connector 24 at the top of the conductor string 20, for introducing high pressure gas to the interior of the string. Also there is an outlet connector 25 that makes connection with the outer annulus 21 and is employed for carrying aerated fluid out from this outer annulus 21.

The source of high pressure gas might involve any feasible arrangement. However, there may be available at the field a suitable high pressure source being employed in gas lifting of oil from wells.

A second string of circulating fluid pipe 28 is inserted inside the first conductor string 20. It goes through appropriate equipment 29 at the well head which includes a blow-out preventer (not shown) and a stripper (not shown). The string 28 forms an inner annulus 32 between it and the conductor string 20, and it will be noted that the connector 24 connects with that inner annulus.

The top of the string 28 has a swivel 33 connected thereto. And, circulating fluid from a tank 36 is driven by a pump 37 down through the string 28 to the level of the sand 15 in the well.

Other equipment at the surface includes a separator 40 that has a gas vent line 41 from the top thereof. It also has fluid connections 44 and 45 which carry the effluent from the well, and the return of circulating fluid respectively.

The separator 40 also has an outlet line 48 for removing sand from the bottom of the separator 40. The removal is accomplished by washing it out using a water line inlet 49. The washed out sand will be accumulated in a sand pit (not shown).

Figure 2:
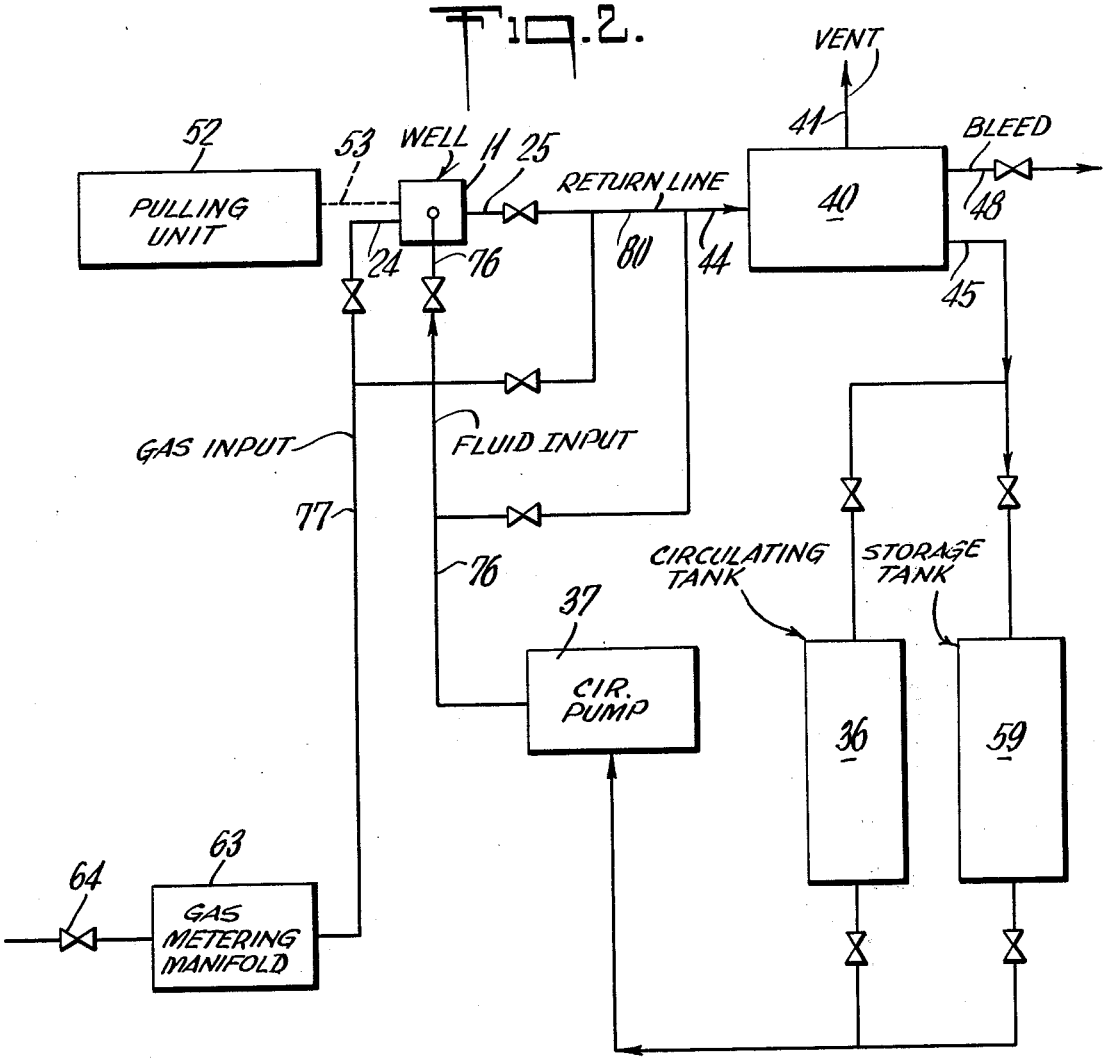
FIG. 2 is a block diagram illustrating a system including the various elements that are employed in carrying out a procedure according to this invention.

FIG. 2 illustrates, by a schematic diagram, the various elements which are employed in carrying out a cleanout method according to the invention. It will be appreciated that a pulling unit 52 is needed. It is not illustrated in FIG. 1, but as indicated in FIG. 2 it provides for the mechanical equipment to be located at the well head for accomplishing the necessary pulling of production tubing, as well as the inserting of the pipe strings which are employed in the cleanout procedure. Such mechanical relationship is illustrated in FIG. 2 by a dashed line 53. In the FIG. 1 illustration, there is an element of the pulling unit indicated by a schematic showing of a pulley block and hook combined unit 56. The hook supports the swivel 33 and the wash string 28, both described above.

Figure 3:
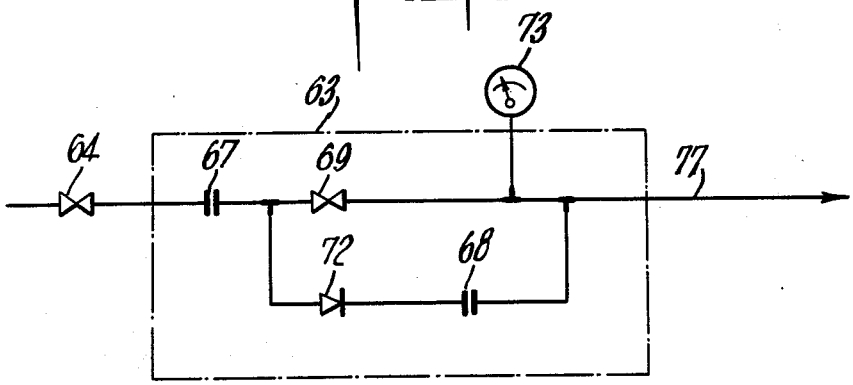
FIG. 3 is a schematic diagram illustrating the details of a gas metering manifold, which is one of the elements indicated in FIG. 2.

FIG. 2 is in the nature of a block layout diagram which shows fluid flow lines with valves indicated at appropriate locations. Also, there are some additional elements that are not indicated in FIG. 1. For example there is a storage tank 59 that is connected in parallel with the circulating tank 36. And there is a gas metering manifold 63 that has some of the details thereof illustrated in FIG. 3.

It will be understood that the high pressure gas which is introduced into the well during the cleanout process according to the invention, is controlled by the elements of the gas metering manifold 63. This manifold 63 is connected on the downstream side of a valve 64.

The manifold 63 is employed for adjusting the introduction of the high pressure gas and controlling the flow thereof. It includes conventional meter connectors 67 and 68 plus a valve 69 and an adjustable choke 72. In addition, there is a pressure gauge 73 for determining the gas pressure that is being applied to the well.

CLEAN-OUT PROCEDURE

The procedure as it is carried out according to this invention, involves at least some of the following steps which (it will be appreciated) may or may not be necessarily in the order described.

First, the sanded well may have its production string (not shown) pulled by use of the pulling unit 52. Then, or in conjunction therewith, there will be a determination made as to the static fluid level 16 in the well. Also, the depth to the top of the sand fill 15 may be determined at that time.

Next, the conductor string 20 will be run into the well 11 to a predetermined depth. It will be run into the well and landed for support at the casing head 12. This will be done with the bottom above the sand fill 15, at some predetermined depth beneath the static fluid level 17.

Then, after connecting the necessary blow-out preventer (not shown) and a stripper head (not shown) as part of the indicated equipment 29, the circulating fluid string 28 will be run into the well until it reaches the top of the sand fill 15. Preferably, this string of pipe will have at the bottom end 23 a full bore, special bit and a non-return valve (not shown) which will assist in the washing procedure as the well is cleaned out.

As the wash string 28 is run into the well, the swivel 33 which is attached to the top thereof, is connected to a circulating fluid line 76 that goes from the pump 37 to the swivel 33.

The gas metering manifold 63 will be connected to the inlet connector 24 via a gas line 77. And, the outlet connector 35 will be coupled up to the separator tank inlet connector 44 via a fluid line 80.

When the foregoing connections have been made, it is appropriate to test the connections for any leaks. Thereafter the metering control valve, i.e. adjustable choke 72, will be opened wide, and also the unloader valve 69 in order to unload the fluid from the annuli 32 and 21. Thereafter the unloader valve 69 will be closed and the wash fluid will be made to circulate down the wash string 28 at an appropriate rate.

It will be clear from the foregoing that the step of starting to circulate the wash fluid down the wash string 28 is carried out while the application of the high pressure gas is made adjustable following the fluid unloading.

Then the choke 72 will be adjusted to maintain sufficient gas pressure down the inner annulus 32 so that the flow of fluid will continue in gentle surges up the outer annulus 21 and out through the connector 25 and fluid line 80 to the separator 40.

It will be appreciated that the washing fluid flow will pick up sand 15 and mix it with the well fluid 16 so that as the gas aerates the mixture it will all flow up the outer annulus 21 and out through the connector 25, the fluid line 80 and the connection 44 to the separator 40.

The washing operation is continued down the well as far as required to clean out all the sand 15. This may include adding sections of pipe to the circulating string 28, and this should be done with a minimum of delay. However, if it is accomplished without shutting off the choke of metering control valve 72, the operation will be continuous so as to avoid the necessity of offloading and readjusting at the metering manifold 63.

It will be understood that the procedure could be carried out with reversal of the direction of flow in the outer and inner annuli 21 and 32 respectively although the procedure described above is preferred.

It may be noted that the procedure lends itself to the use of oil as the circulating fluid and consequently there will be no damage to the producing formation.

It will be understood that the gas which is used in this procedure may be taken from the same source as that used in gas lift operations. Consequently, care must be exercised to maintain safety precautions.

While a particular embodiment of the invention has been described above in considerable detail in accordance with the applicable statutes, this is not to be taken as in any way limiting the invention but merely as being description thereof.

I claim:

1. Cleanout procedure for a low pressure well containing sand fill and well fluid therein, comprising the steps of:

inserting a first string of pipe in said well and forming an outer annulus therearound in the well, said first string extending below the static fluid level of said well fluid in said well, inserting a second string of pipe inside said first string and forming an inner annulus between said strings, said second string extending adjacent to the top of said sand fill, applying a gas under pressure to one of said annuli, and circulating a wash fluid down said second string of pipe to wash out sand with gas entrained fluid through the other of said annuli.

2. Cleanout procedure according to claim 1, further comprising:

separating said washed out sand for disposal, and recirculating said wash fluid.

3. Cleanout procedure according to claim 2, further comprising:

a first step of removing any production string of pipe from said well.

4. Cleanout procedure according to claim 3, further comprising:

separating said gas from said gas entrained fluid.

5. Cleanout procedure according to claim 4, wherein:

said gas is applied to said inner annulus.

6. Cleanout procedure according to claim 3, wherein:

said gas is applied to said inner annulus.

7. Cleanout procedure according to claim 2, wherein:

said gas is applied to said inner annulus.

8. Cleanout procedure according to claim 1, wherein:

said gas is applied to said inner annulus.

9. Cleanout procedure for a low pressure well having a casing head and a string of production tubing therein and containing sand fill, comprising the steps of:

removing said production string, determining the static fluid level and the level of sand fill in said well, inserting a first string of conductor pipe in said well to form an outer annulus between the walls of said well and the outside of said conductor pipe string, landing said first string of conductor pipe for support at said casing head with the bottom above said sand fill level but beneath said static fluid level, connecting an inlet connector for high pressure gas to the inside of said first string of conductor pipe, connecting an outlet connector for a return line to carry effluent from said outer annulus to a separator, inserting a second string of circulating fluid pipe inside said first string of conductor pipe to form an inner annulus between said first and second strings, attaching said second string of pipe, to a swivel with the bottom of the string at the level of said sand fill, applying a high pressure gas to said inlet connector for unloading fluid from said inner annulus via said outer annulus, starting to circulate wash fluid down through said second string of pipe while adjusting said application of high pressure gas to maintain circulation in gentle surges, and washing down with said second string of pipe to clean out said sand.

10. Cleanout procedure for a well with low bottom hole pressure containing sand fill, comprising the steps of:

first removing any production string of pipe from said well, inserting a first string of pipe in said well and forming an outer annulus therearound in said well, said first string extending below the static fluid level in said well, inserting a second string of pipe inside said first string and forming an inner annulus between said strings, said second string extending adjacent to the top of said sand fill, applying a gas under high pressure to said inner annulus, circulating a wash fluid down said second string of pipe to wash out said sand with gas entrained fluid through said outer annulus, separating said washed out sand for disposal, separating said gas from said gas entrained fluid, and recirculating said wash fluid while continuing the foregoing steps until said sand fill has been removed from the well.

* * * * *